US008979669B2

(12) United States Patent
Greaney et al.

(10) Patent No.: US 8,979,669 B2
(45) Date of Patent: Mar. 17, 2015

(54) POLYMER COVER LAYER FOR GOLF CLUB FACE

(75) Inventors: Mark Vincent Greaney, Vista, CA (US); Bing-Ling Chao, San Diego, CA (US); Sanjay Mukatira Kuttappa, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 517 days.

(21) Appl. No.: 13/330,486

(22) Filed: Dec. 19, 2011

(65) Prior Publication Data

US 2012/0172143 A1 Jul. 5, 2012

Related U.S. Application Data

(60) Provisional application No. 61/428,657, filed on Dec. 30, 2010.

(51) Int. Cl.
*A63B 53/04* (2006.01)

(52) U.S. Cl.
CPC ..... *A63B 53/0466* (2013.01); *A63B 53/047* (2013.01); *A63B 2209/00* (2013.01)
USPC ..... 473/330; 473/342

(58) Field of Classification Search
USPC ..... 473/324–350
See application file for complete search history.

(56) References Cited

U.S. PATENT DOCUMENTS

| | | | | |
|---|---|---|---|---|
| 3,937,474 | A * | 2/1976 | Jepson et al. | 473/342 |
| 4,326,716 | A * | 4/1982 | LaCoste | 473/349 |
| 5,458,332 | A * | 10/1995 | Fisher | 473/251 |
| 5,716,290 | A * | 2/1998 | Baker et al. | 473/313 |
| 5,931,743 | A * | 8/1999 | Baker et al. | 473/313 |
| 5,938,543 | A * | 8/1999 | McGeeney et al. | 473/324 |
| 6,176,791 | B1 * | 1/2001 | Wright | 473/252 |
| 6,238,302 | B1 * | 5/2001 | Helmstetter et al. | 473/340 |
| 6,244,972 | B1 * | 6/2001 | Drossos | 473/224 |
| 6,273,831 | B1 * | 8/2001 | Dewanjee | 473/324 |
| 6,273,832 | B1 * | 8/2001 | Helmstetter et al. | 473/324 |
| 6,375,583 | B1 * | 4/2002 | Solheim | 473/329 |
| 6,406,379 | B1 * | 6/2002 | Christensen | 473/251 |
| 6,425,831 | B1 * | 7/2002 | Heene et al. | 473/332 |
| 6,428,427 | B1 * | 8/2002 | Kosmatka | 473/349 |
| 6,607,451 | B2 * | 8/2003 | Kosmatka et al. | 473/329 |
| 6,683,152 | B2 * | 1/2004 | Wu et al. | 528/63 |
| 6,971,960 | B2 * | 12/2005 | Dewanjee et al. | 473/340 |
| 7,037,985 | B2 * | 5/2006 | Kim et al. | 525/457 |
| 7,175,540 | B2 * | 2/2007 | Sano | 473/332 |
| 7,278,926 | B2 * | 10/2007 | Frame | 473/329 |
| 2005/0130761 | A1 | 6/2005 | Vokey et al. | |
| 2006/0094536 | A1 | 5/2006 | Morales | |
| 2009/0163291 | A1 | 6/2009 | Chao | |
| 2012/0172143 | A1 * | 7/2012 | Greaney et al. | 473/329 |

FOREIGN PATENT DOCUMENTS

| | | | | |
|---|---|---|---|---|
| DE | 4022663 A1 * | 1/1992 | | C08G 18/32 |
| EP | 320946 A2 * | 6/1989 | | C08G 18/32 |

* cited by examiner

*Primary Examiner* — Alvin Hunter
(74) *Attorney, Agent, or Firm* — Klarquist Sparkman, LLP

(57) ABSTRACT

A golf club head, comprising a striking surface having an outer cover layer comprising a polyurethane or polyurea having a material Shore D hardness of 40 to 70, a layer thickness of 0.2 to 0.6 mm, and a flexural modulus of 5 to 110 kpsi.

22 Claims, 1 Drawing Sheet

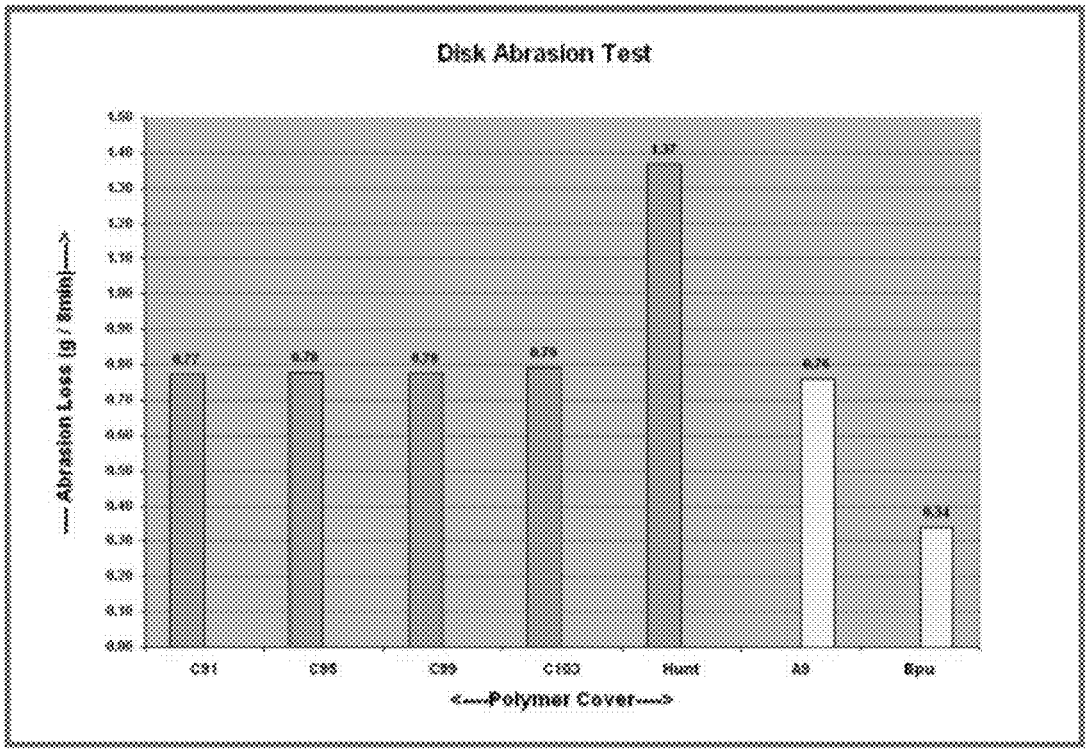
Disk Abrasion Test
<----Abrasion Loss (g / 8min)---->
<----Polymer Cover---->
Hunt
8pu

POLYMER COVER LAYER FOR GOLF CLUB FACE

CROSS-REFERENCE TO RELATED APPLICATION

This application claims the benefit of U.S. Provisional Application No. 61/428,657, filed Dec. 30, 2010, which is incorporated herein by reference in its entirety.

BACKGROUND

With the ever-increasing popularity and competitiveness of golf, substantial effort and resources are currently being expended to improve golf clubs so that increasingly more golfers can have more enjoyment and more success at playing golf. Much of this improvement activity has been in the realms of sophisticated materials and club-head engineering. For example, modern "wood-type" golf clubs (notably, "drivers", "fairway woods", and "utility clubs"), with their sophisticated shafts and non-wooden club-heads, bear little resemblance to the "wood" drivers, low-loft long-irons, and higher numbered fairway woods used years ago. These modern wood-type clubs are generally called "metal-woods".

An exemplary metal-wood golf club such as a fairway wood or driver typically includes a hollow shaft having a lower end to which the club-head is attached. Most modern versions of these club-heads are made, at least in part, of a light-weight but strong metal such as titanium alloy. The club-head comprises a body to which a strike plate (also called a face plate) is attached or integrally formed. The strike plate defines a front surface or strike face that actually contacts the golf ball.

A factor in modern club-head design is the face plate. Impact of the face plate with the golf ball results in some rearward instantaneous deflection of the face plate. This deflection and the subsequent recoil of the face plate are expressed as the club-head's coefficient of restitution (COR). A thinner face plate deflects more at impact with a golf ball and potentially can impart more energy and thus a higher rebound velocity to the struck ball than a thicker or more rigid face plate. Because of the importance of this effect, the COR of clubs is limited under United States Golf Association (USGA) rules.

Regarding the total mass of the club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the club-head to address performance issues, for example.

Some current approaches to reducing structural mass of a club-head are directed to making at least a portion of the club-head of an alternative material. Whereas the bodies and face plates of most current metal-woods are made of titanium alloy, several "hybrid" club-heads are available that are made, at least in part, of components formed from both graphite/epoxy-composite (or another suitable composite material) and a metal alloy. For example, in one group of these hybrid club-heads a portion of the body is made of carbon-fiber (graphite)/epoxy composite and a titanium alloy is used as the primary face-plate material. Other club-heads are made entirely of one or more composite materials. Graphite composites have a density of approximately 1.5 g/cm$^3$, compared to titanium alloy which has a density of 4.5 g/cm$^3$, which offers tantalizing prospects of providing more discretionary mass in the club-head.

Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers is substantial, e.g., fifty or more. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition.

Conventional processes by which fiber-resin composites are fabricated into club-head components utilize high (and sometimes constant) pressure and temperature to cure the resin portion in a minimal period of time. The processes desirably yield components that are, or nearly are, "net-shape", by which is meant that the components as formed have their desired final configurations and dimensions. Making a component at or near net-shape tends to reduce cycle time for making the components and to reduce finishing costs. Unfortunately, at least three main defects are associated with components made in this conventional fashion: (a) the components exhibit a high incidence of composite porosity (voids formed by trapped air bubbles or as a result of the released gases during a chemical reaction); (b) a relatively high loss of resin occurs during fabrication of the components; and (c) the fiber layers tend to have "wavy" fibers instead of straight fibers. Whereas some of these defects may not cause significant adverse effects on the service performance of the components when the components are subjected to simple (and static) tension, compression, and/or bending, component performance typically will be drastically reduced whenever these components are subjected to complex loads, such as dynamic and repetitive loads (i.e., repetitive impact and consequent fatigue).

Manufacturers of metal wood golf club-heads have more recently attempted to manipulate the performance of their club heads by designing what is generically termed a variable face thickness profile for the striking face. It is known to fabricate a variable-thickness composite striking plate by first forming a lay-up of prepreg plies, as described above, and then adding additional "partial" layers or plies that are smaller than the overall size of the plate in the areas where additional thickness is desired (referred to as the "partial ply" method). For example, to form a projection on the rear surface of a composite plate, a series of annular plies, gradually decreasing in size, are added to the lay-up of prepreg plies.

Unfortunately, variable-thickness composite plates manufactured using the partial ply method are susceptible to a high incidence of composite porosity because air bubbles tend to remain at the edges of the partial plies (within the impact zone of the plate). Moreover, the reinforcing fibers in the prepreg plies are ineffective at their ends. The ends of the fibers of the partial plies within the impact zone are stress concentrations, which can lead to premature delamination and/or cracking. Furthermore, the partial plies can inhibit the steady outward flow of resin during the curing process, leading to resin-rich regions in the plate. Resin-rich regions tend to reduce the efficacy of the fiber reinforcement, particularly since the force resulting from golf-ball impact is generally transverse to the orientation of the fibers of the fiber reinforcement.

Typically, conventional CNC machining is used during the manufacture of composite face plates, such as for trimming a cured part. Because the tool applies a lateral cutting force to the part (against the peripheral edge of the part), it has been found that such trimming can pull fibers or portions thereof out of their plies and/or induce horizontal cracks on the peripheral edge of the part. As can be appreciated, these defects can cause premature delamination and/or other failure of the part.

While durability limits the application of non-metals in striking plates, even durable plastics and composites exhibit some additional deficiencies. Typical metallic striking plates include a fine ground striking surface (and for iron-type golf clubs may include a series of horizontal grooves) that tends to promote a preferred ball spin in play under wet conditions. This fine ground surface appears to provide a relief volume for water present at a striking surface/ball impact area so that impact under wet conditions produces a ball trajectory and shot characteristics similar to those obtained under dry conditions. While non-metals suitable for striking plates are durable, these materials generally do not provide a durable roughened, grooved, or textured striking surface such as provided by conventional clubs and that is needed to maintain club performance under various playing conditions. Accordingly, improved striking plates, striking surfaces, and golf clubs that include such striking plates and surfaces and associated methods are needed.

SUMMARY

Disclosed herein is a golf club head, comprising a striking surface having an outer cover layer comprising a polyurethane or polyurea having a material Shore D hardness of 40 to 70, a layer thickness of 0.2 to 0.6 mm, and a flexural modulus of 5 to 110 kpsi.

Also disclosed herein is a golf club head, comprising a striking surface having an outer cover layer comprising a polyurethane wherein the polyurethane is the reaction product of a toluene diisocyanate-terminated polyether prepolymer and a curative package that includes a curing agent and at least two additives selected from an antioxidant, UV absorber, and a light stabilizer.

Further disclosed herein is a golf club head, comprising a striking surface having an outer cover layer comprising a polyurethane or polyurea having a layer thickness of 0.2 to 0.6 mm, and a flexural modulus of 2 to 70 kpsi, wherein the polyurethane or polyurea is a reaction product of a polyurethane prepolymer or polyurea prepolymer that has 3 to 10 mol % free NCO groups with a curative.

Additionally disclosed herein is a golf club head, comprising a striking surface having an outer cover layer comprising a polyurethane or polyurea having a layer thickness of 0.2 to 0.6 mm, and a flexural modulus of greater than 70 to 120 kpsi, wherein the polyurethane or polyurea is a reaction product of a polyurethane prepolymer or polyurea prepolymer that has 5 to 20 mol % free NCO groups with a curative.

Further disclosed herein is a golf club head, comprising a striking surface having an outer cover layer comprising a polyurethane or polyurea having a material Shore D hardness of 30 to 70, a layer thickness of 0.2 to 0.6 mm, and a flexural modulus of 2 to 120 kpsi.

The foregoing will become more apparent from the following figures and detailed description.

BRIEF DESCRIPTION OF DRAWINGS

FIG. 1 is a graph depicting abrasion test results for several different polyurethane covers.

DETAILED DESCRIPTION

The term "bimodal polymer" as used herein refers to a polymer comprising two main fractions and more specifically to the form of the polymer's molecular weight distribution curve, i.e., the appearance of the graph of the polymer weight fraction as a function of its molecular weight. When the molecular weight distribution curves from these fractions are superimposed onto the molecular weight distribution curve for the total resulting polymer product, that curve will show two maxima or at least be distinctly broadened in comparison with the curves for the individual fractions. Such a polymer product is called bimodal. The chemical compositions of the two fractions may be different.

The term "chain extender" as used herein is a compound added to either a polyurethane or polyurea prepolymer, (or the prepolymer starting materials), which undergoes additional reaction but at a level sufficiently low to maintain the thermoplastic properties of the final composition The term "conjugated" as used herein refers to an organic compound containing two or more sites of unsaturation (e.g., carbon-carbon double bonds, carbon-carbon triple bonds, and sites of unsaturation comprising atoms other than carbon, such as nitrogen) separated by a single bond.

The term "curing agent" or "curing system" as used interchangeably herein is a compound added to either polyurethane or polyurea prepolymer, (or the prepolymer starting materials), which imparts additional crosslinking to the final composition to render it a thermoset.

The term "(meth)acrylate" is intended to mean an ester of methacrylic acid and/or acrylic acid.

The term "(meth)acrylic acid copolymers" is intended to mean copolymers of methacrylic acid and/or acrylic acid.

The term "polyurea" as used herein refers to materials prepared by reaction of a diisocyanate with a polyamine.

The term "polyurethane" as used herein refers to materials prepared by reaction of a diisocyanate with a polyol.

The term "prepolymer" as used herein refers to any material that can be further processed to form a final polymer material of a manufactured golf ball, such as, by way of example and not limitation, a polymerized or partially polymerized material that can undergo additional processing, such as crosslinking.

The term "thermoplastic" as used herein is defined as a material that is capable of softening or melting when heated and of hardening again when cooled. Thermoplastic polymer chains often are not cross-linked or are lightly crosslinked using a chain extender, but the term "thermoplastic" as used herein may refer to materials that initially act as thermoplastics, such as during an initial extrusion process or injection molding process, but which also may be crosslinked, such as during a compression molding step to form a final structure.

The term "thermoplastic polyurea" as used herein refers to a material prepared by reaction of a prepared by reaction of a diisocyanate with a polyamine, with optionally addition of a chain extender.

The "thermoplastic polyurethane" as used herein refers to a material prepared by reaction of a diisocyanate with a polyol, with optionally addition of a chain extender.

The term "thermoset" as used herein is defined as a material that crosslinks or cures via interaction with as crosslinking or curing agent. The crosslinking may be brought about by energy in the form of heat (generally above 200° C.) through a chemical reaction (by reaction with a curing agent), or by irradiation. The resulting composition remains rigid when set, and does not soften with heating. Thermosets have this property because the long-chain polymer molecules cross-link with each other to give a rigid structure. A thermoset material cannot be melted and re-molded after it is cured thus thermosets do not lend themselves to recycling unlike thermoplastics, which can be melted and re-molded.

The term "thermoset polyurethane" as used herein refers to a material prepared by reaction of a diisocyanate with a polyol, and a curing agent.

The term "thermoset polyurea" as used herein refers to a material prepared by reaction of a diisocyanate with a polyamine, and a curing agent.

The term "urethane prepolymer" as used herein is the reaction product of diisocyanate and a polyol.

The term "urea prepolymer" as used herein is the reaction product of a diisocyanate and a polyamine.

The term "unimodal polymer" refers to a polymer comprising one main fraction and more specifically to the form of the polymer's molecular weight distribution curve, i.e., the molecular weight distribution curve for the total polymer product shows only a single maximum.

A protective outer coating (also referred to herein as a "polymer cover") is needed for composite faces or coated metallic faces (such as ion plated) as they wear quickly. The outer coating is made from a polymer as disclosed herein and can include a textured or roughened surface. The outer coating will protect the face from abrasion caused by an impact and general day-to-day use (dropping the club etc.). An outer coating also can reduce or eliminate deterioration of the surface finish of the club face caused by sand or dirt transferred from the golf ball.

Several parameters have been discovered to unexpectedly affect abrasion resistance including hardness, flexural modulus, polyurethane curative, and polyurethane prepolymer. In one embodiment, it has been found that an outer coating made from a polyurethane or polyurea having a material Shore D hardness of 30 to 80, more particularly 30 to 70 (resulting in a Shore D hardness on the club face of 70 to 80), and most particularly 35-60, a layer thickness of 0.1 to 1 mm, more particularly 0.2 to 0.6 mm, most particularly 0.2 to 0.5 mm, and especially 0.3 to 0.35 mm, and a flexural modulus of 2 to 120 kpsi, and more particularly 5 to 110 kpsi, provides superior abrasion resistance and durability.

In one embodiment, the outer coating has a low material flexural modulus (e.g., 2 to 70 kpsi, more particularly 5 to 15 kpsi). A low material flexural modulus coating requires a relatively higher degree of surface roughness texturing to achieve a given level of golf ball spin. A low material flexural modulus coating can be obtained, for example, with a polyurethane prepolymer or polyurea prepolymer that has 3 to 10 mol % free NCO groups and/or utilizing a fast-reacting polyamine curative as described in more detail below.

In another embodiment, the outer coating has a high material flexural modulus (e.g., greater than 70 to 120 kpsi). A high material flexural modulus coating requires a relatively lower degree of surface roughness texturing to achieve a given level of golf ball spin. A high materials flexural modulus coating can be obtained, for example, with a polyurethane prepolymer or polyurea prepolymer that has 5 to 20 mol % free NCO groups and/or utilizing a slow-reacting polyamine curative as described in more detail below.

One preferred family of polymers for making the golf club face cover layer of the present invention are the thermoplastic or thermoset polyurethanes and polyureas made by combination of a polyisocyanate and a polyol or polyamine respectively. Any isocyanate available to one of ordinary skill in the art is suitable for use in the present invention including, but not limited to, aliphatic, cycloaliphatic, aromatic aliphatic, aromatic, any derivatives thereof, and combinations of these compounds having two or more isocyanate (NCO) groups per molecule, as described below in more detail.

Any polyol available to one of ordinary skill in the polyurethane art is suitable for use according to the invention. Polyols suitable for use include, but are not limited to, polyester polyols, polyether polyols, polycarbonate polyols and polydiene polyols such as polybutadiene polyols, as described below in more detail.

Any polyamine available to one of ordinary skill in the polyurea art is suitable for use according to the invention. Polyamines suitable for use include, but are not limited to, amine-terminated hydrocarbons, amine-terminated polyethers, amine-terminated polyesters, amine-terminated polycaprolactones, amine-terminated polycarbonates, amine-terminated polyamides, and mixtures thereof, as described below in more detail.

The previously described diisocyanate and polyol or polyamine components may be previously combined to form a prepolymer prior to reaction with the chain extender or curing agent. Any such prepolymer combination is suitable for use in the present invention. Commercially available prepolymers include LFH580, LFH120, LFH710, LFH1570, LF930A, LF950A, LF601D, LF751D, LFG963A, and LFG640D, as described below in more detail.

In one embodiment, the prepolymer is an aromatic isocyanate-terminated polyether prepolymer. One preferred prepolymer is a toluene diisocyanate prepolymer with polypropylene glycol. Such polypropylene glycol terminated toluene diisocyanate prepolymers are available from Chemtura of Middlebury, Conn., under the trade name ADIPRENE® LFG963A and LFG640D. Most preferred prepolymers are the polytetramethylene ether glycol terminated toluene diisocyanate prepolymers including those available from Chemtura of Middlebury, Conn., under the trade name ADIPRENE® LF930A, LF950A, LF601D, and LF751D. In certain embodiments, a blend of prepolymers may be used.

Polyol chain extenders or curing agents may be primary, secondary, or tertiary polyols. Diamines and other suitable polyamines may be added to the compositions of the present invention to function as chain extenders or curing agents. These include primary, secondary and tertiary amines having two or more amines as functional groups, as described below in more detail. In certain embodiments, the amount of curing agent combined with the amount of prepolymer is sufficient to react 90 to 97 wt %, more particularly 90 to 95 wt %, of the available isocyanate groups in the prepolymer.

Depending on their chemical structure, curing agents may be slow- or fast-reacting polyamines or polyols. As described in U.S. Pat. Nos. 6,793,864, 6,719,646 and copending U.S. Patent Publication No. 2004/0201133 A1, (the contents of all of which are hereby incorporated herein by reference).

A slow-reacting curing agent with respect to amines means that the amine groups on the curing agent are sterically and/or electronically hindered because of the presence of electron withdrawing groups or interfering bulky groups situated adjacent to the reaction sites. A long chain flexible spacer of at least four carbons between reaction sites or three carbons with electron withdrawing groups also contributes to the slower reactivity of polyamines. Suitable curatives for use in the present invention are selected from the slow-reacting polyamine group include, but are not limited to, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, and mixtures thereof. Of these, 3,5-dimethylthio-2,4-toluenediamine and 3,5-dimethylthio-2,6-toluenediamine are isomers and are sold under the trade name ETHACURE® 300 by Ethyl Corporation. Trimethylene glycol-di-p-aminobenzoate is sold under the trade name POLACURE 740M and polytetramethyleneoxide-di-p-aminobenzoates are sold under the trade name POLAMINES by Polaroid Corporation. N,N'-dialkyldiamino diphenyl methane is sold under the trade name UNILINK® by UOP. Fast reacting curing agents, do not have electron withdrawing groups or bulky groups that interfere with the reaction groups and exhibit fast gel times approximately less than 50 seconds). Suitable fast-reacting curing agent can be used include diethyl-2,4-toluenediamine, 4,4"-methylenebis-(3-chloro,2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis(2-hydroxypropyl)ethylenediamine and Curalon L, a trade name for a mixture of aromatic diamines sold by Uniroyal, Inc. or any and all combinations thereof. A preferred fast-reacting curing agent is diethyl-2,4-toluene diamine (including diethyl-2,4-toluene diamine/diethyl-2,64-toluene diamine isomeric mixture), which is commercially available, for example, as Ethacure® 100 and Ethacure® 100LC commercial grade which has lower color and less by-product, and Vibracure® A-89 available from Chemtura. Blends of fast and slow curing agents are especially preferred.

In another preferred embodiment the polyurethane or polyurea is prepared by combining a diisocyanate with either a polyamine or polyol or a mixture thereof and one or more dicyandiamides. In a preferred embodiment the dicyandiamide is combined with a urethane or urea prepolymer to form a reduced-yellowing polymer composition as described in U.S. Patent Application No. 60/852,582 filed on Oct. 17, 2006, the entire contents of which are herein incorporated by reference in their entirety.

In what is known as a one-shot process, the three reactants, diisocyanate, polyol or polyamine, and optionally a chain extender or a curing agent, are combined in one step. Alternatively, a two-step process may occur in which the first step involves reacting the diisocyanate and the polyol (in the case of polyurethane) or the polyamine (in the case of a polyurea) to form a so-called prepolymer, to which can then be added either the chain extender or the curing agent. This procedure is known as the prepolymer process.

In addition, although depicted as discrete component packages as above, it is also possible to control the degree of crosslinking, and hence the degree of thermoplastic or thermoset properties in a final composition, by varying the stoichiometry not only of the diisocyanate-to-chain extender or curing agent ratio, but also the initial diisocyanate-to-polyol or polyamine ratio. Of course in the prepolymer process, the initial diisocyanate-to-polyol or polyamine ratio is fixed on selection of the required prepolymer.

In addition to discrete thermoplastic or thermoset materials, it also is possible to modify thermoplastic polyurethane or polyurea compositions by introducing materials in the composition that undergo subsequent curing after molding the thermoplastic to provide properties similar to those of a thermoset. For example, Kim in U.S. Pat. No. 6,924,337, the entire contents of which are hereby incorporated by reference, discloses a thermoplastic urethane or urea composition optionally comprising chain extenders and further comprising a peroxide or peroxide mixture, which can then undergo post curing to result in a thermoset.

Also, Kim et al. in U.S. Pat. No. 6,939,924, the entire contents of which are hereby incorporated by reference, discloses a thermoplastic urethane or urea composition, optionally also comprising chain extenders, that are prepared from a diisocyanate and a modified or blocked diisocyanate which unblocks and induces further cross linking post extrusion. The modified isocyanate preferably is selected from the group consisting of: isophorone diisocyanate (IPDI)-based uretdione-type crosslinker; a combination of a uretdione adduct of IPDI and a partially ϵ-caprolactam-modified IPDI; a combination of isocyanate adducts modified by ϵ-caprolactam and a carboxylic acid functional group; a caprolactam-modified Desmodur diisocyanate; a Desmodur diisocyanate having a 3,5-dimethylpyrazole modified isocyanate; or mixtures of these.

Finally, Kim et al. in U.S. Pat. No. 7,037,985 B2, the entire contents of which are hereby incorporated by reference, discloses thermoplastic urethane or urea compositions further comprising a reaction product of a nitroso compound and a diisocyanate or a polyisocyanate. The nitroso reaction product has a characteristic temperature at which it decomposes to regenerate the nitroso compound and diisocyanate or polyisocyanate. Thus, by judicious choice of the post-processing temperature, further crosslinking can be induced in the originally thermoplastic composition to provide thermoset-like properties.

Any isocyanate available to one of ordinary skill in the art is suitable for use in the polyurethanes or polyureas used in the present invention. Isocyanates for use with the present invention include, but are not limited to, aliphatic, cycloaliphatic, aromatic aliphatic, aromatic, any derivatives thereof, and combinations of these compounds having two or more isocyanate (NCO) groups per molecule. As used herein, aromatic aliphatic compounds should be understood as those containing an aromatic ring, wherein the isocyanate group is not directly bonded to the ring. One example of an aromatic aliphatic compound is a tetramethylene diisocyanate (TMXDI). The isocyanates may be organic polyisocyanate-terminated prepolymers, low free isocyanate prepolymer, and mixtures thereof. The isocyanate-containing reactable component also may include any isocyanate-functional monomer, dimer, trimer, or polymeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O—C—N—R—N—O, where R preferably is a cyclic, aromatic, or linear or branched hydrocarbon moiety containing from about 1 to about 50 carbon atoms. The isocyanate also may contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group (s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof.

Examples of isocyanates that can be used with the present invention include, but are not limited to, substituted and isomeric mixtures including 2,2'-, 2,4'-, and 4,4'-diphenylmethane diisocyanate (MDI); 3,3'-dimethyl-4,4'-biphenylene diisocyanate (TODI); toluene diisocyanate (TDI); polymeric MDI; carbodiimide-modified liquid 4,4'-diphenylmethane diisocyanate; para-phenylene diisocyanate (PPDI); meta-phenylene diisocyanate (MPDI); triphenyl methane-4,4'- and triphenyl methane-4,4"-triisocyanate; naphthylene-1,5-diisocyanate; 2,4'-, 4,4'-, and 2,2-biphenyl diisocyanate; polyphenylene polymethylene polyisocyanate (PMDI) (also known as polymeric PMDI); mixtures of MDI and PMDI; mixtures of PMDI and TDI; ethylene diisocyanate; propylene-1,2-diisocyanate; trimethylene diisocyanate; butylenes diisocyanate; bitolylene diisocyanate; tolidine diisocyanate; tetramethylene-1,2-diisocyanate; tetramethylene-1,3-diisocyanate; tetramethylene-1,4-diisocyanate; pentamethylene diisocyanate; 1,6-hexamethylene diisocyanate (HDI); octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; diethylidene diisocyanate; methylcyclohexylene diisocyanate (HTDI); 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl)dicyclohexane; isophorone diisocyanate (IPDI); dimeryl diisocyanate, dodecane-1,12-diisocyanate, 1,10-decamethylene diisocyanate, cyclohexylene-1,2-diisocyanate, 1,10-decamethylene diisocyanate, 1-chlorobenzene-2,4-diisocyanate, furfurylidene diisocyanate, 2,4,4-trimethyl hexamethylene diisocyanate, 2,2,4-trimethyl hexamethylene diisocyanate, dodecamethylene diisocyanate, 1,3-cyclopentane diisocyanate, 1,3-cyclohexane diisocyanate, 1,3-cyclobutane diisocyanate, 1,4-cyclohexane diisocyanate, 4,4'-methylenebis(cyclohexyl isocyanate), 4,4'-methylenebis(phenyl isocyanate), 1-methyl-2,4-cyclohexane diisocyanate, 1-methyl-2,6-cyclohexane diisocyanate, 1,3-bis(isocyanato-methyl)cyclohexane, 1,6-diisocyanato-2,2,4,4-tetra-methylhexane, 1,6-diisocyanato-2,4,4-tetra-trimethylhexane, trans-cyclohexane-1,4-diisocyanate, 3-isocyanato-methyl-3,5,5-trimethylcyclohexyl isocyanate, 1-isocyanato-3,3,5-trimethyl-5-isocyanatomethylcyclohexane, cyclohexyl isocyanate, dicyclohexylmethane 4,4'-diisocyanate, 1,4-bis(isocyanatomethyl)cyclohexane, m-phenylene diisocyanate, m-xylylene diisocyanate, m-tetramethylxylylene diisocyanate, p-phenylene diisocyanate, p,p'-biphenyl diisocyanate, 3,3'-dimethyl-4,4'-biphenylene diisocyanate, 3,3'-dimethoxy-4,4'-biphenylene diisocyanate, 3,3'-diphenyl-4,4'-biphenylene diisocyanate, 4,4'-biphenylene diisocyanate, 3,3'-dichloro-4,4'-biphenylene diisocyanate, 1,5-naphthalene diisocyanate, 4-chloro-1,3-phenylene diisocyanate, 1,5-tetrahydronaphthalene diisocyanate, metaxylene diisocyanate, 2,4-toluene diisocyanate, 2,4'-diphenylmethane diisocyanate, 2,4-chlorophenylene diisocyanate, 4,4'-diphenylmethane diisocyanate, p,p'-diphenylmethane diisocyanate, 2,4-tolylene diisocyanate, 2,6-tolylene diisocyanate, 2,2-diphenylpropane-4,4'-diisocyanate, 4,4'-toluidine diisocyanate, dianidine diisocyanate, 4,4'-diphenyl ether diisocyanate, 1,3-xylylene diisocyanate, 1,4-naphthylene diisocyanate, azobenzene-4,4'-diisocyanate, diphenyl sulfone-4,4'-diisocyanate, triphenylmethane 4,4',4"-triisocyanate, isocyanatoethyl methacrylate, 3-isopropenyl-α,α-dimethylbenzyl-isocyanate, dichlorohexamethylene diisocyanate, ω,ω'-diisocyanato-1,4-diethylbenzene, polymethylene polyphenylene polyisocyanate, isocyanurate modified compounds, and carbodiimide modified compounds, as well as biuret modified compounds of the above polyisocyanates. These isocyanates may be used either alone or in combination. These combination isocyanates include triisocyanates, such as biuret of hexamethylene diisocyanate and triphenylmethane triisocyanates, and polyisocyanates, such as polymeric diphenylmethane diisocyanate.triisocyanate of HDI; triisocyanate of 2,2,4-trimethyl-1,6-hexane diisocyanate (TMDI); 4,4'-dicyclohexylmethane diisocyanate ($H_{12}$MDI); 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; meta-tetramethylxylene diisocyanate (m-TMXDI); para-tetramethylxylene diisocyanate (p-TMXDI); trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, and mixtures thereof, dimerized uretdione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof.

Any polyol now known or hereafter developed is suitable for use according to the invention. Polyols suitable for use in the present invention include, but are not limited to, polyester polyols, polyether polyols, polycarbonate polyols and polydiene polyols such as polybutadiene polyols.

Any polyamine available to one of ordinary skill in the polyurethane art is suitable for use according to the invention. Polyamines suitable for use in the compositions of the present invention include, but are not limited to, amine-terminated compounds typically are selected from amine-terminated hydrocarbons, amine-terminated polyethers, amine-terminated polyesters, amine-terminated polycaprolactones, amine-terminated polycarbonates, amine-terminated polyamides, and mixtures thereof. The amine-terminated compound may be a polyether amine selected from polytetramethylene ether diamines, polyoxypropylene diamines, poly (ethylene oxide capped oxypropylene)ether diamines, triethyleneglycoldiamines, propylene oxide-based triamines, trimethylolpropane-based triamines, glycerin-based triamines, and mixtures thereof.

The diisocyanate and polyol or polyamine components may be combined to form a prepolymer prior to reaction with a chain extender or curing agent. Any such prepolymer combination is suitable for use in the present invention. For example, the composition for the coating may be a two-component formulation that includes a component (A) comprising a polyurethane or polyurea prepolymer and a component (B) comprising a curative package that includes a curing agent as described above, and optionally at least one additive selected from a plasticizer, pigment, colorant, antioxidant, dispersant, UV absorber, light stabilizer, optical brightener, mold release agent, processing aid, filler, and any and all combinations thereof. Illustrative antioxidants include hindered phenols, secondary aromatic amines, organophosphorus compounds, thiosynergists, hydroxylamines, lactones, and acrylated bisphenols. Illustrative UV absorbers include benzotriazoles and benzophenones. Illustrative light stabilizers include hindered amines. In certain embodiments, component (B) includes at least two additives selected from an antioxidant, UV absorber, and a light stabilizer. The amount of component (A) may range from 40 to 99 wt %, particularly 50 to 95 wt %, preferably 70 to 90 wt %, and the amount of component (B) may range from 1 to 60 wt %, particularly 5 to 50 wt %, and preferably 10 to 30 wt %, based on the total weight of the mixture of (A) and (B). In certain embodiments, the amount of component (A) may range from 85 to 90 wt %, and the amount of component (B) may range from 10 to 15 wt % in order to obtain a coating with a material flexural modulus of 2 to 70 kpsi. In certain embodiments, the amount of component (A) may range from 75 to 84 wt %, and the amount of component (B) may range from 16 to 25 wt % in order to obtain a coating with a material flexural modulus of greater than 70 to 120 kpsi.

Polyol chain extenders or curing agents may be primary, secondary, or tertiary polyols. Non-limiting examples of monomers of these polyols include: trimethylolpropane (TMP), ethylene glycol, 1,3-propanediol, 1,4-butanediol, 1,5-pentanediol, 1,6-hexanediol, propylene glycol, dipropylene glycol, 1,2-butanediol, 1,3-butanediol, 2,3-butanediol, 1,2-pentanediol, 2,3-pentanediol, 2,5-hexanediol, 2,4-hexanediol, 2-ethyl-1,3-hexanediol, cyclohexanediol, and 2-ethyl-2-(hydroxymethyl)-1,3-propanediol.

Diamines and other suitable polyamines may be added to the compositions of the present invention to function as chain extenders or curing agents. These include primary, secondary and tertiary amines having two or more amines as functional groups. Exemplary diamines include aliphatic diamines, such as tetramethylenediamine, pentamethylenediamine, hexamethylenediamine; alicyclic diamines, such as 3,3'-dimethyl-4,4'-diamino-dicyclohexyl methane; or aromatic diamines, such as diethyl-2,4-toluenediamine, 4,4"-methylenebis-(3-chloro,2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis(2-hydroxypropyl)ethylenediamine, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, 4,4'-methylene bis-2-chloroaniline, 2,2',3,3'-tetrachloro-4,4'-diamino-phenyl methane, p,p'-methylenedianiline, p-phenylenediamine or 4,4'-diaminodiphenyl; and 2,4,6-tris(dimethylaminomethyl) phenol.

Depending on their chemical structure, curing agents may be slow- or fast-reacting polyamines or polyols. As described in U.S. Pat. Nos. 6,793,864, 6,719,646 and copending U.S. Patent Publication No. 2004/0201133 A1, (the contents of all of which are hereby incorporated herein by reference), slow-reacting polyamines are diamines having amine groups that are sterically and/or electronically hindered by electron withdrawing groups or bulky groups situated proximate to the amine reaction sites. The spacing of the amine reaction sites will also affect the reactivity speed of the polyamines.

The chart below shows two embodiments of the outer cover layer disclosed herein:

| Flex mod Range (kpsi) | NCO Range | Spin | Launch Angle | Roughness (Ra, μm) | A (prepolymer wt %) | B Curative wt % | To give Gel Time | Abrasion resistance |
|---|---|---|---|---|---|---|---|---|
| ≥2 and ≤70 | 3-10 mol % | Equiv to steel | Eq to steel | 3-10 | 85-90, e.g., 89.0 | 10-15, e.g., 11 | 40-120 secs | <0.8, pref <0.6, more pref <0.4 g/8 min |
| >70 and <120 | 5-20 mol % | Eq to steel | Eq to steel | 0.5-5 | 75-84, e.g., 82.0 | 16-25, e.g., 18 | 20-100 secs | <0.8, pref <0.6, more pref <0.4 g/8 min |

EXAMPLES

Preparation of Polymer Cover

Step 1

A substrate having the required dimension for the final face insert is selected. The substrate is made from a composite as described in US 2009/0163291. The substrate surface is cleaned with an acetone wipe, and then wetted with water and abraded with an abrasion pad (3M ScotchBrite Type A fine) using hand pressure for 45 seconds and washed again with soapy water to remove all residual sand. The sample is then acetone wiped and air dried. The sample is then exposed to an air (atmospheric), vacuum or flame plasma treatment. The sample is then primed by spray painting the surface with Chokwang W-Primer(U), followed by drying/curing for 20 minutes at 130° F. in a forced convection oven.

Preparation of the Polymer Mixture

The prepolymer and the curative blend components are dynamically mixed using a standard urethane dispenser available in the market and known to any in the art of liquid polyurethane chemistry employed in the industry. A mixer such as the SEE-Flo 2K Gear Meter Mix Dispense System—Model 995 by Sealant Equipment Company) may be employed to mix and dispense the two components at the right ratio on to the part before molding. Here the prepolymer and curative are maintained in tanks and recirculated at the required temperatures and flow-rate to maintain the right ratio between the prepolymer and curative blend and a 3-way valve or switching system is employed to pour the material through a mixer on to the part. The mixer may be a static or dynamic mixer. After the mixture is poured or dispensed on to the mold or the composite part which needs the polyurethane cover, it is then compression molded to conform to the thickness and patterns in the mold within or close to the gel time of the mixture dispensed. Any compression molding machine or equipment that gives the required tonnage and temperature that is available in the market may be employed to compress the dispensed material at a given temperature of 100-300° F. from 2-20 minutes, sufficient to yield a cured or crosslinked part that can be demolded. These parts are later post-cured to their fully crosslinked state at 200-250° F. for 16-24 hours before any other operations such as cutting and bonding are performed.

Application of Cover

The treated substrate is mounted onto a two piece mold, the mold having an upper part with fastening means (clips or vacuum) for holding the substrate in place. The lower part of the mold has on its interior surface any texture and/or score-lines which will be subsequently imparted to the final piece which is configured to receive the polymer mixture used to form the final part/endcap. The components A and B of the formulation are (A) prepolymer (Chemtura LF 950A) and (B) curative (a mixture of 80 wt % Vibrathane A89 and 20 wt % Tinuvin B75) to give a final prepolymer to curative weight ratio of 86 wt % prepolymer to 14 wt % curative. Chemtura LF 950A is a toluene diisocyanate-terminated polyether prepolymer with a NCO mol % of 5.9-6.2, and less than 0.1% free TDI. Vibrathane A89 is an isomeric mixture of diethyltoluene diamine. Tinuvin B75 is a liquid blend of an antioxidant ($C_{7-9}$ branched alkyl esters of 3,5-di-tert-butyl-4-hydroxyhydrocinnamic acid, (Irganox 1135)); a hindered amine (bis(1,2,2,6,6-pentamethyl-4-piperidinyl)sebacate (Tinuvin 765)); and a UV absorber (2-(2H-benzotriazole-2-yl)-6-dodecyl-4-methylphenol (Tinuvin 571)). These components are metered using a gear pump. Using a semi-continuous urethane dispenser and mixer (Sealant Equipment Engineering Servo-Flo 704) the required amount (about 6 grams) is dispensed via a semi-continuous dynamic mixhead onto the bottom part of the mold. Alternately, dispense may be made to the upper mold half. The upper mold half is then closed and compressed in a compression press under a load of from about 1,000 to about 20,000 pounds and held for about 6 to 12 minutes at 130° F. to 180° F. A mold release may be used prior to molding to help demold the cured part easily. This part is then washed and may be post-cured for 16 hours at 200° F.

This molded part is then cut using a CNC machine or water-jet method to conform to the driver head cavity and then bonded with epoxy (3M Scotch-Weld DP-420 adhesive) and cured for 30 minutes to 1 hour at 70° C. before use.

Abrasion Resistance

A LECO Spectrum System 2000 grinder polisher that uses silicon carbide 12" disks with a 180 grit was utilized for an abrasion test. Polyurethane specimens were prepared by molding plates of $\frac{1}{8}^{th}$ inch thickness and punching out small circular disks with a $\frac{15}{16}$" punch. These disks were adhered with double-side tape onto inserts that are 1" Ø and ½" thick with a ⅛" thick shoulder of 1.25" Ø. This is then mounted onto a machine holder that holds six specimens and ground for 1 minute at 100 RPM with an individual load of 2 lbs each with water turned on during grinding. The specimens are then taken out with the inserts and weighed and then run at the above conditions for 8 minutes and reweighed for weight loss. The weight loss for 8 minutes is reported as an average for 3 specimens in the table below.

The results are shown in FIG. 1. Specimens C91 through C103 are polyurethane covers cured at 91 through 103% theory for prepolymers to curative. Specimens C91 through C103 are polyurethanes made from a TDI-terminated polyether prepolymer with a 9 mol % NCO (commercially available from Chemtura as LF751D) and a curative that is a blend of 4,4"-methylenebis-(3-chloro,2,6-diethyl)-aniline (MCDEA) and diethyltoluene diamine (DETDA). Polyurethane commercially available from Huntsman is marked as "Hunt" in FIG. 1, "A9" is same as C95 molded another day and "Bpu" is a 6% NCO TDI prepolymer LF950A from Chemtura (cured). An abrasion loss of less than 0.8 g per 8 minutes is considered acceptable. Anything lower would be preferred and abrasion loss of 0.34 or lower would be considered superior. The abrasion results correlated well with a sandy ball test conducted with these materials on a club with lower abrasion loss providing improved sandy ball test performance.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A golf club head, comprising a striking surface having an outer cover layer comprising a polyurethane or polyurea having a material Shore D hardness of 40 to 70, a layer thickness of 0.2 to 0.6 mm, and a flexural modulus of 5 to 110 kpsi and wherein the outer cover layer has a surface roughness Ra of 3 to 10 μm and an abrasion resistance of less than 0.8 g/8 min.

2. The golf club head of claim 1, wherein the polyurethane comprises a reaction product of a diisocyanate/polyol prepolymer and a curing agent, wherein an amount of curing agent is combined with an amount of prepolymer sufficient to react 90 to 95 wt % of available isocyanate groups in the prepolymer.

3. The golf club head of claim 1, wherein the polyurethane is made from a toluene diisocyanate.

4. A golf club head, comprising a striking surface having an outer cover layer comprising a polyurethane wherein the polyurethane is the reaction product of a toluene diisocyanate-terminated polyether prepolymer and a curative package that includes a curing agent and at least two additives selected from an antioxidant, a UV absorber, and a light stabilizer and wherein the outer cover layer has a surface roughness Ra of 3 to 10 μm and an abrasion resistance of less than 0.8 g/8 min .

5. The golf club head of claim 4, wherein the polyurethane has a material Shore D hardness of 40 to 70, a layer thickness of 0.2 to 0.6 mm, and a flexural modulus of 2 to 110 kpsi.

6. The golf club head of claim 5, wherein an amount of curing agent is combined with an amount of prepolymer sufficient to react 90 to 95 wt % of available isocyanate groups in the prepolymer.

7. A golf club head, comprising a striking surface having an outer cover layer comprising a polyurethane or polyurea having a layer thickness of 0.2 to 0.6 mm, and a flexural modulus of 2 to 70 kpsi, wherein the polyurethane or polyurea is a reaction product of a polyurethane prepolymer or polyurea prepolymer that has 3 to 10 mol% free NCO groups with a curative and wherein the outer cover layer has a surface roughness Ra of 3 to 10 μm and an abrasion resistance of less than 0.8 g/8 min.

8. The golf club head of claim 7, wherein the curative comprises a slow-reacting polyamine curing agent.

9. The golf club head of claim 8, wherein the curative includes a curing agent and at least two additives selected from an antioxidant, a UV absorber, and a light stabilizer, the polyurethane prepolymer comprises a toluene diisocyanate-terminated polyether prepolymer, and the polyurethane or polyurea has a flexural modulus of 5 to 15 kpsi.

10. The golf club head of claim 7, wherein the curative includes a curing agent and at least two additives selected from an antioxidant, a UV absorber, and a light stabilizer.

11. The golf club head of claim 7, wherein the polyurethane prepolymer comprises a toluene diisocyanate-terminated polyether prepolymer.

12. The golf club head of claim 7, wherein the flexural modulus is 5 to 15 kpsi.

13. The golf club head of claim 7, wherein the reaction product comprises a reaction product of 85-90 wt % polyurethane prepolymer or polyurea prepolymer with 10-15 wt % curative, based on the total weight of the prepolymer/curative reaction mixture.

14. A golf club head, comprising a striking surface having an outer cover layer comprising a polyurethane or polyurea having a layer thickness of 0.2 to 0.6 mm, and a flexural modulus of greater than 70 to 120 kpsi, wherein the polyurethane or polyurea is a reaction product of a polyurethane prepolymer or polyurea prepolymer that has 5 to 20 mol % free NCO groups with a curative and wherein the outer cover layer has a surface roughness Ra of 3 to 10 μm and an abrasion resistance of less than 0.8 g/8 min.

15. The golf club head of claim 14, wherein the curative comprises a fast-reacting polyamine curing agent.

16. The golf club head of claim 15, wherein the curative includes a curing agent and at least two additives selected from an antioxidant, a UV absorber, and a light stabilizer, the polyurethane prepolymer comprises a toluene diisocyanate-terminated polyether prepolymer, the outer cover layer has a surface roughness Ra of 0.5 to 5 μm.

17. The golf club head of claim 14, wherein the curative includes a curing agent and at least two additives selected from an antioxidant, a UV absorber, and a light stabilizer.

18. The golf club head of claim 14, wherein the polyurethane prepolymer comprises a toluene diisocyanate-terminated polyether prepolymer.

19. The golf club head of claim 14, wherein the outer cover layer has a surface roughness Ra of 0.5 to 5 μm.

20. The golf club head of claim 14, wherein the reaction product comprises a reaction product of 75-84 wt % polyurethane prepolymer or polyurea prepolymer with 16-25 wt % curative, based on the total weight of the prepolymer/curative reaction mixture.

21. A golf club head, comprising a striking surface having an outer cover layer comprising a polyurethane or polyurea having a material Shore D hardness of 30 to 70, a layer thickness of 0.2 to 0.6 mm, and a flexural modulus of 2 to 120 kpsi and wherein the outer cover layer has a surface roughness Ra of 3 to 10 μm and an abrasion resistance of less than 0.8 g/8 min.

22. The golf club head of claim 21, wherein the polyurethane comprises a reaction product of a diisocyanate/polyol prepolymer and a curing agent, wherein an amount of curing agent is combined with an amount of prepolymer sufficient to react 90 to 97 wt % of available isocyanate groups in the prepolymer.

* * * * *